US005473648A

United States Patent [19]

Larson et al.

[11] Patent Number: 5,473,648

[45] Date of Patent: Dec. 5, 1995

[54] DECONTAMINATION PROCESS

[75] Inventors: Richard I. Larson; Michael R. Chilton, both of Wilimington, N.C.

[73] Assignee: General Electric Company, N.Y.

[21] Appl. No.: 228,776

[22] Filed: Apr. 18, 1994

[51] Int. Cl.[6] ..... G21C 19/42

[52] U.S. Cl. ..... 376/310; 376/457; 252/640; 252/643

[58] Field of Search ..... 376/310, 457; 423/20, 261; 148/237; 252/626, 640, 643; 588/15

[56] References Cited

U.S. PATENT DOCUMENTS

| | | | |
|---|---|---|---|
| 3,080,262 | 5/1963 | Newman et al. | 134/3 |
| 3,080,323 | 5/1963 | Newman et al. | 252/103 |
| 3,853,980 | 12/1974 | Berton et al. | 423/12 |
| 3,873,362 | 3/1975 | Mihram et al. | 134/3 |
| 4,419,249 | 12/1983 | Jayawant | 210/721 |
| 4,610,732 | 9/1986 | Sasaki et al. | 148/6.14 R |
| 4,666,979 | 5/1987 | Plank et al. | 525/54.21 |
| 4,704,235 | 11/1987 | Arvesen | 252/626 |
| 4,913,849 | 4/1990 | Husain | 252/626 |
| 5,205,999 | 4/1993 | Willis et al. | 423/20 |
| 5,278,743 | 1/1994 | Bengel et al. | 376/310 |

*Primary Examiner*—Donald P. Walsh
*Assistant Examiner*—Meena Chelliah
*Attorney, Agent, or Firm*—Nixon & Vanderhye

[57] ABSTRACT

The present invention relates to a process of decontaminating zirconium-based alloy claddings tubes used in nuclear reactor fuel rods. The process involved the use of a permanganate in a dilute acid solution. The process renders the alloy suitable for uncontrolled release into a non-radioactive environment.

10 Claims, No Drawings

DECONTAMINATION PROCESS

BACKGROUND OF THE INVENTION

1. Field of the Invention

The present invention relates, in general, to a decontamination process and, in particular, to a process of decontaminating zirconium-based alloy claddings tubes of nuclear reactor fuel rods.

2. Background Information

Fuel rods of nuclear reactor assemblies consist of $UO_2$ pellets and a zirconium-based alloy (e.g. Zircaloy) cladding tube. The rods are made by stacking the $UO_2$ pellets into cladding tubes approximately 13 feet in length. During the process of loading the pellets into the tube, $UO_2$ can become embedded into the Zircaloy or zirconium surface. Deposition of $UO_2$ can also occur as the rods are transported through the factory or as $UO_2$ pellets are removed from defective rods. The cladding material must then be decontaminated before it can be recycled for future use in the production of reactor fuel bundles.

Typically, decontamination of Zircaloy begins with the high temperature oxidation of $UO_2$ to form $U_3O_8$. In a subsequent step, the particulate $U_3O_8$ is reacted with concentrated nitric acid (about 3 molar). This step dissolves the uranium contaminant as well as the zirconium base metal and results in the formation of uranyl nitrate and zirconium nitrate. This method presents significant handling problems since the resulting waste solutions are highly corrosive. In addition, the zirconium nitrate formed during the process poses a significant fire and explosion hazard.

OBJECTS AND SUMMARY OF THE INVENTION

It is a general object of the invention to provide a process of decontaminating a zirconium-based alloy cladding material containing deposits of $UO_2$ that renders the zirconium suitable for unconditional release into a non-radioactive environment.

It is a specific object of the invention to provide a process of chemically decontaminating Zircaloy cladding tubes that avoids destruction of the base metal.

It is another object of the invention to provide a process of decontaminating Zircaloy that minimizes the corrosiveness of the resulting waste liquids.

It is a further object of the invention to provide a process of decontaminating Zircaloy that avoids the potential for fire and explosion resulting from zirconium nitrate formation.

The present invention relates to a process that meets these objectives. Specifically, the invention relates to a process of directly oxidizing $UO_2$ present on the surface of a zirconium-based alloy using permanganate in a dilute acid solution. Manganese oxides or hydroxides formed as a result of the oxidation that are present as a residue on the Zircaloy surface are removed using dilute acid. Dilute acid is also used to remove any residual uranium oxides.

Further objects and advantages of the present invention will be clear from the description that follows.

DETAILED DESCRIPTION OF THE INVENTION

The present invention provides a process of chemically decontaminating a zirconium-based alloy cladding material containing $UO_2$ deposits so as to render it suitable for unconditional release. Zirconium resulting from the present process can be recycled, in a non-radioactive environment, for future use as cladding material in reactor fuel bundles.

According to the process of the invention, $UO_2$ deposited on the surface of a zirconium-based alloy (e.g. Zircaloy) is oxidized with a permanganate in the presence of a dilute acid. Various permanganates can be used, however, potassium permanganate and sodium permanganate are preferred, potassium permanganate being the more preferred. Likewise, various acids can be used, including nitric acid, hydrochloric acid and sulfuric acid, as well as combinations thereof, nitric acid being preferred.

Oxidation of $UO_2$ is preferably effected using an aqueous solution of permanganate having a concentration in the range of 0.01M to 0.03M, 0.02M being preferred. Acid (preferably, nitric acid) is present in the permanganate solution at a concentration in the range of 0.003M to 0.004M, a concentration of about 0.003M being preferred. The permanganate solution is preferably maintained at a temperature of 90° C. to 98° C. during the oxidation process, 90° C. being preferred. The oxidation period is preferably at least 2 hr.

In order to facilitate-the oxidation process, the tubes of cladding material can be placed into a reaction vessel that permits the decontamination solution to pass through the interior of the tube and over the exterior surface of the tube. The reaction vessel can be designed to accomplish hydraulic flow either by natural circulation or by force. By circulating the permanganate solution over the surfaces of the cladding material, both the formation of uranyl ion and the dissolution rate are increased.

While not limiting the invention to any particular reaction mechanism, it is believed that oxidation of $UO_2$ in accordance with the present invention occurs as follows:

$$2MnO_4^- + 16H^+ + 5UO_2 \rightarrow 2Mn^{++} + 5UO_2^{++} + 8H_2O$$

Manganese (2+) ion in the presence of air reacts with hydroxide as follows to produce a stable, brown precipitate of MnO(OH):

$$2Mn^{++} + 2OH^- + O_2 \rightarrow 2MnO(OH)$$

The brown precipitate is insoluble in water but soluble in acid.

Zirconium-based alloy subjected to permanganate decontamination as described above has deposited on the surface thereof a brown residue. The residue, which is believed to be MnO(OH) produced as described above, can be dissolved using a solution containing an acid that solubilizes metal hydroxides. Suitable acids remove residues of manganese (+2 or +4) or uranium (+6) oxides and include oxalic acid and acetic acid. Oxalic acid is preferred for this purpose (manganese oxalate, $MnC_2O_4$, is known to be soluble in aqueous oxalic acid solutions (see Seidell, Solubilities—Inorganic and Metal-organic Compounds (1965) p. 556)) and the reaction conditions are described below with reference thereto. Oxalic or other such acid can be used alone or in combination with a second acid that increases solubility of the manganese residue, nitric acid being preferred.

Oxalic acid is, preferably, maintained at a concentration in the range of 0.006M to 0.016M, to 0.011M being preferred. When a second acid, such as nitric acid, is used, the concentration of that acid is maintained in the range of 0.007M to 0.017M, 0.012M being preferred. The temperature of the oxalic acid-containing solution is preferably 90° C. to 98° C., 90° C. being preferred and the treatment time is, advantageously, at least 2 hr. As in the case of the oxidation step, the oxalic acid-containing solution can be circulated over the interior and exterior surfaces of the cladding material.

Following decontamination, the inner and outer surfaces of the tubes are monitored, using appropriate counters, for gamma and alpha activity. To be suitable for unconditional release into a non-radioactive environment, the following requirements must be met:

| | |
|---|---|
| Alpha activity (smearable) | <220 dpm/100 $cm^2$ |
| Alpha activity (fixed) | <2000 dpm/100 $cm^2$ |
| Beta and gamma activity | <1000 dpm/100 $cm^2$ |
| | <0.2 mr/hr avg |
| | <0.1 mr/hr at any point. |

The total uranium content of the zirconium alloy must be less than 3.5 ppm, with the $U^{235}$ content being less than 0.03 ppm (see A STM Standard Specification for Zirconium and Zirconium Alloy Ingots for Nuclear Application B350-91). Material meeting these requirements can be recycled for future use in the preparation of fuel bundle assemblies. The decontamination process described above can be repeated, if necessary, to ensure that the requirements are satisfied.

The following non-limiting Example describes certain aspects of the invention in greater detail.

EXAMPLE

Decontamination of Zircaloy Tubes

Zircaloy tubes (approximately 13 feet in length) contaminated with $UO_2$ were decontaminated as follows:

1) The tubes were placed vertically in a reaction vessel such that aqueous decontamination solution (A), containing 0.02M potassium permanganate and 0.003M nitric acid, passed through the interior of the tube and flowed adjacent to the outer surface of the tube. The temperature of solution A was 90° C. and the treatment period was two hours.

2) Subsequent to step (1) above, the tubes were treated for a further 2 hour period, at 90° C., with an aqueous solution of 0.011M oxalic acid and 0.012M nitric acid.

The radioactivity associated with tubes decontaminated as described above was determined and the levels were significantly below the unconditional release limits:

Contact readings:

Alpha activity—background

Beta and gamma activity—background

Smearable reading:

Alpha activity—not detected

Beta and gamma activity—<100 dpm

Dark manganese hydroxide and oxide deposits were observed on the surface of the Zircaloy tubes following the first decontamination step (ie, treatment with solution A). The second decontamination solution removed those deposits, leaving a bright metal surface.

A number of batches of decontaminated Zircaloy tubes have been formed into ingots. For the initial batch, the total uranium content, as determined by two independent laboratories, was 4.78 ppm and 2.11 ppm. The amount of uranium in the decontamination solutions indicated the contaminated Zircaloy tubes had an initial uranium content of 213 ppm based on the Zircaloy tube weight.

Subsequent decontamination trials of contaminated tubes resulted in total uranium contents of less than 3.5 ppm. In these trials, the contaminated tubes were twice subjected to the two step procedure described above.

In addition to the acid-permanganate studies described above, experiments were also conducted using a basic solution of potassium permanganate (sodium hydroxide being used as the base). The alkaline-based sodium hydroxide/potassium permanganate solution was not found to decontaminate Zircaloy tubes sufficiently to be unconditionally released.

All documents cited above are hereby incorporated in their entirety by reference.

One skilled in the art will appreciate from a reading of this disclosure that various changes in form and detail can be made without departing from the true scope of the invention.

What is claimed is:

1. A process of removing a $UO_2$ contaminate from a zirconium-based alloy comprising:

i) contacting said $UO_2$ contaminated zirconium-based alloy with a permanganate-containing dilute acid solution under conditions such that oxidation of said $UO_2$ and dissolution of the resulting $UO_2$ oxidation product into said solution are effected, and ii) removing said zirconium-based alloy from said solution.

2. The process according to claim 1 wherein said acid is present in said solution at a concentration of 0.003 to 0.004M.

3. The process according to claim 1 wherein the concentration of said permanganate is in the range of 0.01M to 0.03M.

4. The process according to claim 1 wherein said acid is nitric acid.

5. The process according to claim 1 further comprising contacting said zirconium-based alloy resulting from step (ii) with an acid that dissolves manganese hydroxides under conditions such that manganese hydroxides present on the surface of said zirconium-based alloy resulting from step (ii) are dissolved.

6. The method according to claim 5 wherein said acid that dissolves manganese hydroxides is oxalic acid or acetic acid.

7. The method according to claim 1 wherein said zirconium-based alloy is Zircaloy.

8. The method according to claim 1 wherein said permanganate is potassium permanganate.

9. The method according to claim 1 wherein said oxidation of $UO_2$ is effected at a temperature in the range of 90° C. to 98° C.

10. The method according to claim 1 wherein, subsequent to said oxidation step (i), said zirconium-based alloy has a smearable alpha activity of not more than 220 dpm/100 $cm^2$, a fixed alpha activity of not more than 2000 dpm/100 $cm^2$, a beta/gamma activity of not more than 1000 dpm/100 $cm^2$, not more than 0.2 mr/hr average and not more than 0.1 mr/hr at any point.

* * * * *